US011131010B2

(12) United States Patent
Tetsui et al.

(10) Patent No.: US 11,131,010 B2
(45) Date of Patent: Sep. 28, 2021

(54) TITANIUM ALLOY AND METHOD OF MANUFACTURING MATERIAL FOR TIMEPIECE EXTERIOR PART

(71) Applicants: NATIONAL INSTITUTE FOR MATERIALS SCIENCE, Ibaraki (JP); CITIZEN WATCH CO., LTD, Tokyo (JP)

(72) Inventors: Toshimitsu Tetsui, Tsukuba (JP); Masahiro Satoh, Iruma (JP); Takayuki Ogawa, Tokyo (JP)

(73) Assignees: National Institute for Materials Science, Ibaraki (JP); Citizen Watch Co., Ltd., Tokyo (JP)

( * ) Notice: Subject to any disclaimer, the term of this patent is extended or adjusted under 35 U.S.C. 154(b) by 141 days.

(21) Appl. No.: 16/092,401

(22) PCT Filed: Apr. 13, 2017

(86) PCT No.: PCT/JP2017/015114
§ 371 (c)(1),
(2) Date: Oct. 9, 2018

(87) PCT Pub. No.: WO2017/179652
PCT Pub. Date: Oct. 19, 2017

(65) Prior Publication Data

US 2019/0177816 A1 Jun. 13, 2019

(30) Foreign Application Priority Data

Apr. 14, 2016 (JP) ..... JP2016-081506

(51) Int. Cl.
*C22C 14/00* (2006.01)
*C22F 1/18* (2006.01)
*C22F 1/00* (2006.01)

(52) U.S. Cl.
CPC ..... *C22C 14/00* (2013.01); *C22F 1/18* (2013.01); *C22F 1/183* (2013.01); *C22F 1/00* (2013.01)

(58) Field of Classification Search
CPC ..... C22C 14/00; C22F 1/18; C22F 1/183
(Continued)

(56) References Cited

U.S. PATENT DOCUMENTS 5,509,979 A 4/1996 Kimura
6,270,914 B1 * 8/2001 Ogasawara ..... C23C 10/28 428/610
(Continued)

FOREIGN PATENT DOCUMENTS

JP 07-062466 A 3/1995
JP 07-150274 A 6/1995
(Continued)

OTHER PUBLICATIONS

Palm, et al., "Assessment of the Al—Fe—Ti System", Intermetallics, vol. 14, No. 10-11, pp. 1291-1303 (2006).
(Continued)

*Primary Examiner* — Jie Yang
(74) *Attorney, Agent, or Firm* — Hoffmann & Baron LLP

(57) ABSTRACT

A titanium alloy of the present invention includes aluminum at a ratio of 28.0 at % or more and 38.0 at % or less, iron at a ratio of 2.0 at % or more and 6.0 at % or less, and titanium and inevitable impurities as the balance or includes aluminum at a ratio of 28.0 at % or more and 38.0 at % or less, manganese at a ratio of 4.0 at % or more and 8.0 at % or less, and titanium and inevitable impurities as the balance. Further, the titanium alloy of the present invention may include silicon at a ratio of 0.3 at % or more and 1.5 at % or less.

4 Claims, 4 Drawing Sheets

(58) Field of Classification Search
USPC ..... 148/421
See application file for complete search history.

(56) References Cited

U.S. PATENT DOCUMENTS

| | | | | |
|---|---|---|---|---|
| 6,306,196 | B1 * | 10/2001 | Date | B22F 3/225 428/547 |
| 2009/0041609 | A1 * | 2/2009 | Duz | C22C 1/1084 419/12 |
| 2015/0044505 | A1 | 2/2015 | Nishikawa et al. | |
| 2017/0067137 | A1 * | 3/2017 | Kawasaki | C22C 14/00 |

FOREIGN PATENT DOCUMENTS

| | | | |
|---|---|---|---|
| JP | 09-145855 | A | 6/1997 |
| JP | 2008-127667 | A | 6/2008 |
| JP | 2009-114513 | A | 5/2009 |
| JP | 2015-036148 | A | 2/2015 |

OTHER PUBLICATIONS

Supplementary Partial European Search Report for corresponding European Application No. 17782465.3, pp. 1-11 (dated Jul. 31, 2019).

"Standard Manual for Chemical Engineering Equipment, Metallic Materials (Second Book), vol. 1", Technology Center of Process Equipment of Ministry of Chemical Industry, p. 439, Dec. 31, 1996.

Chinese Office Action for Application No. 201780022390.4, dated Mar. 16, 2020 (with Machine Translation).

International Search Report, International Application No. PCT/JP2017/015114, 2 pages, dated Jul. 18, 2017.

"Manufacture of Titanium-based Materials", Yang Baoxiang, et al., p. 429, Beijing: Metallurgical Industry Press, Jan. 2015, (Machine Translation).

Third Chinese Office Action for Application No. 201780022390.4, dated Aug. 12, 2020 (with Machine Translation).

* cited by examiner

TITANIUM ALLOY AND METHOD OF MANUFACTURING MATERIAL FOR TIMEPIECE EXTERIOR PART

CROSS-REFERENCE TO RELATED APPLICATIONS

This application is the U.S. National Phase Application of International Application No. PCT/JP2017/015114, filed on Apr. 13, 2017, and asserts priority to Japanese Patent Application No. 2016-081506 filed on Apr. 14, 2016, all of which are hereby incorporated by reference in their entirety.

TECHNICAL FIELD

The present invention relates to a titanium alloy which has excellent toughness and hot forgeability with high hardness, and further remarkably small incidence of a skin allergy, and a method of manufacturing a material for a timepiece exterior part made of a titanium alloy.

Priority is claimed on Japanese Patent Application No. 2016-081506, filed on Apr. 14, 2016, the content of which is incorporated herein by reference.

BACKGROUND ART

In recent years, Ti-based alloy (titanium alloy) is widely used as a material for a timepiece exterior part. The Ti-based alloy is significantly lighter than stainless steel of the related art, and has remarkably good corrosion resistance to sea water or the like. In addition, elements such as Hg, Ni, Cr, and Co, which may cause a skin allergy, are known. However, the Ti-based alloy is excellent in that it is possible to form the Ti-based alloy excluding the elements and form such that a possibility of causing a skin allergy is remarkably lowered.

However, since the Ti-based alloy of the related art is soft, in order to prevent the Ti-based alloy from being scratched and improve aesthetics by mirror polishing of a surface, a hardening treatment such as a nitriding treatment was required. However, there were problems that due to this hardening treatment, surface roughness deteriorated, a surface state was roughened and colored, the design was single, and the feeling of high quality was significantly impaired. Accordingly, there was a need for a Ti-based alloy which does not require the hardening treatment and of which a material itself is hard and can mirror polished. Specifically, there was a need for a Ti-based alloy having a Vickers hardness of HV 600 or more. Vickers hardness is a unit indicating the hardness.

However, in general, when hardening the material, the material becomes brittle. Therefore, when pursuing the hardness and becoming extremely brittle, problems that the material cannot be processed into a timepiece exterior part and is destroyed during use occur. Accordingly, toughness which does not cause these problems is required for a timepiece exterior material.

In addition, uniformity of the microstructure of the material is necessary in order to prevent unevenness in color tone or light intensity from occurring. Therefore, it is not appropriate to use a cast material of which the microstructure is not uniform, and it is necessary to use a forging material of which the microstructure was homogenized. Also, since a casting defect may be present in the cast material, from this viewpoint, it is necessary to use the forging material. In order to use the forging material based on the needs, excellent forging workability is required for an alloy to be used.

In order to improve the hardness of a Ti-based alloy, many proposals devising a composition of additive elements have been made until now. However, even under any proposal, sufficient hardness has not been made. Patent Document 1 discloses a decorative titanium alloy which contains 0.5% or more of iron in terms of weight. However, the maximum Vickers hardness of the disclosed titanium alloy is approximately HV 400, which is insufficient from the viewpoint of preventing the titanium alloy from being scratched or enhancing mirror polishing property.

Patent Document 2 proposes a Ti alloy containing 4.5% (wt %, hereinafter, the same will be applied) of Al, 3% of V, 2% of Fe, 2% of Mo, and 0.1% of O. However, the Vickers hardness of the Ti alloy is HV 440, which is still insufficient from the viewpoint of preventing the Ti alloy from being scratched or enhancing the effect of mirror finishing.

Patent Document 3 discloses a titanium alloy which contains 4.0 to 5.0% of aluminum, 2.5 to 3.5% of vanadium, 1.5 to 2.5% of molybdenum, and 1.5 to 2.5% of iron, in terms of weight, with the balance including titanium and inevitable components. Although the Vickers hardness of this titanium alloy is not explicitly described in the specification, a composition thereof is not much different from the composition of the titanium alloy of Patent Document 2. Therefore, for the hardness as well, it is considered to be approximately HV 440.

Patent Document 4 discloses a germanium-containing high strength titanium alloy which contains Nb at a ratio of more than 20% and 40% or less, Ge at a ratio of 0.2% to 4.0%, and further one or more of Ta, W, V, Cr, Ni, Mn, Co, Fe, Cu. and Si at a ratio of 15% or less in total in terms of mass %, with the balance including Ti and inevitable impurities, in which cold workability is excellent. Although the Vickers hardness thereof is not explicitly described, since this alloy is a β type titanium alloy as described in paragraph [0004] of the specification, it is hard to think that the titanium alloy is extremely hard compared to the above described various titanium alloys.

In this manner, in order to improve the hardness of the Ti-based alloy, various devising relating to the additive element has been made. However, in any case, improvement of hardness is slight. Therefore, at least a hardening treatment for a surface was required. Therefore, problems that the design was single and the feeling of high quality was significantly impaired occurred.

CITATION LIST

Patent Literature

[Patent Document 1] Japanese Unexamined Patent Application, First Publication No. H7-62466

[Patent Document 2] Japanese Unexamined Patent Application, First Publication No. H7-150274

[Patent Document 3] Japanese Unexamined Patent Application, First Publication No. H9-145855

[Patent Document 4] Japanese Unexamined Patent Application, First Publication No. 2008-127667

SUMMARY OF INVENTION

Technical Problem

The present invention was made in view of the above circumstances, and an object thereof is to provide a Ti-based alloy which is hard enough that a hardening treatment of a surface is not necessary, specifically, the Vickers hardness is approximately HV 600 or more, and hot forgeability is excellent, and which is not extremely brittle.

Solution to Problem

In general, hardness, strength, and ductility of a metal material are closely related, and as the hardness increases the strength increases and the ductility decreases. In other words, a hard material which is an object of the present invention has a high strength but a low ductility. When the ductility is low, hot forgeability is naturally low. Therefore, a problem such as material cracking during forging work occurs. That is, it is usually a difficult technical task to make both hardness and hot forgeability compatible.

However, since hardness is required at room temperature and hot forgeability is necessary at high temperature, the present inventors thought that they may develop a Ti-based alloy which is remarkably hard at room temperature but rapidly softens at high temperature. In addition, in order to realize this, the present inventors thought that it is effective to utilize a β phase present in a Ti-based alloy.

In the Ti-based alloy, the β phase is a high-temperature phase of a solid solution. Therefore, as described in the description of the related art, by adding a β-stabilizing element such as Nb, V, or Mo, the β phase can be stabilized so as to be present even in room temperature. However, in an ordinary Ti-based alloy, the β phase is a soft solid solution rich in deformability from room temperature to high temperature. Accordingly, although hot forgeability at high temperature is good, improvement of hardness at room temperature was limited as in the related art.

Therefore, the present inventors thought about increasing an Al concentration remarkably more than that in the related art. In a Ti—Al-based alloy in which the Al concentration increased, in a case where the β phase is stabilized by a β stabilizing additive element, the β phase remains as a solid solution at high temperature, but undergoes order transformation into a B2 phase of an intermetallic compound at room temperature. Since the intermetallic compound phase is a hard phase with small deformability, improvement of hardness can be expected. In other words, it was thought that in the β phase present in Ti—Al—M (M: β-stabilizing element), when utilizing a phenomenon of order transformation of the solid solution phase at high temperature into the intermetallic compound phase at room temperature, it is possible to obtain an alloy which is soft at high temperature during hot forging and is hard at room temperature. This is the basic idea of the present invention.

Next, the present inventors investigated the appropriate additive element for stabilizing the β phase. In general, there are a large number of β-stabilizing elements such as Cr, Mo, V, Mn, Fe, Nb, and Co in a Ti-based or Ti—Al based alloy, and for industrial parts or the like, Ti-based alloys having various properties have been developed by freely selecting these elements. However, in a timepiece exterior part that is a subject of the present invention, it is not appropriate to use additive elements that may cause skin allergy. Therefore, it is not possible to use Cr, Ni, and Co, and it is necessary to consider β phase stabilization by other elements.

In addition, since the additive element is substituted in a solid solution state in the β phase, a crystal structure itself of the phase does not depend on a kind of an additive element. However, mechanical properties of the phase such as ductility at high temperature, hardness at room temperature, and brittleness at room temperature vary depending on an additive element of a solid solution and an amount thereof. In addition, an influence of an Al concentration is very large. Therefore, in order to obtain an alloy which is, at room temperature, hard and not extremely brittle and at high temperature, excellent in forgeability, it is necessary to find an appropriate type of additive component and appropriate values for an addition amount thereof and an Al concentration. The present inventors conducted a number of experiments from the viewpoint. The present invention is made on the basis of such experiments and has a configuration as follows.

[1] According to an aspect of the present invention, there is provided a titanium alloy including: aluminum at a ratio of 28.0 at % or more and 38.0 at % or less; iron at a ratio of 2.0 at % or more and 6.0 at % or less; and titanium and inevitable impurities as the balance.

[2] In the titanium alloy according to [1] may further include silicon at a ratio of 0.3 at % or more and 1.5 at %, or less.

[3] According to another aspect of the present invention, there is provided a titanium alloy including: aluminum at a ratio of 28.0 at % or more and 38.0 at % or less; manganese at a ratio of 4.0 at % or more and 8.0 at % or less; and titanium and inevitable impurities as the balance.

[4] According to still another aspect of the present invention, there is provided a method of manufacturing a material for a timepiece exterior part, the method including: a step of working the titanium alloy according to any one of [1] to [3]; and a step of heat-treating the hot worked titanium alloy.

Advantageous Effects of Invention

The titanium alloy of the present invention includes aluminum at a higher concentration than that in the related art, and includes iron or manganese as a β-stabilizing element. In addition, concentrations of aluminum and these additive elements are optimized. Therefore, a β phase which is a phase forming the alloy has a property of remaining as a solid solution phase having ductility at high temperature but undergoing order transformation into a hard intermetallic compound phase (B2 phase) at room temperature. Accordingly, the titanium alloy of the present invention can avoid the problem of being broken in a hot environment during hot forging, and can add working strain to the extent necessary. Therefore, according to the effect, it is possible to homogenize a microstructure, which is required for the timepiece exterior material.

In addition, in a room temperature environment when used as an exterior part of a timepiece or the like, the titanium alloy has sufficient hardness (Vickers hardness of HV 600 or more) and has toughness to the extent capable of avoiding problems such as breakage during use. Compared to the titanium alloy of the related art, the mirror polishing property or scratch resistance are remarkably improved. The titanium alloy can be used as a suitable material for an exterior part for a timepiece and the like.

DESCRIPTION OF EMBODIMENTS

First Embodiment (Configuration of Titanium Alloy)

Figure 1:
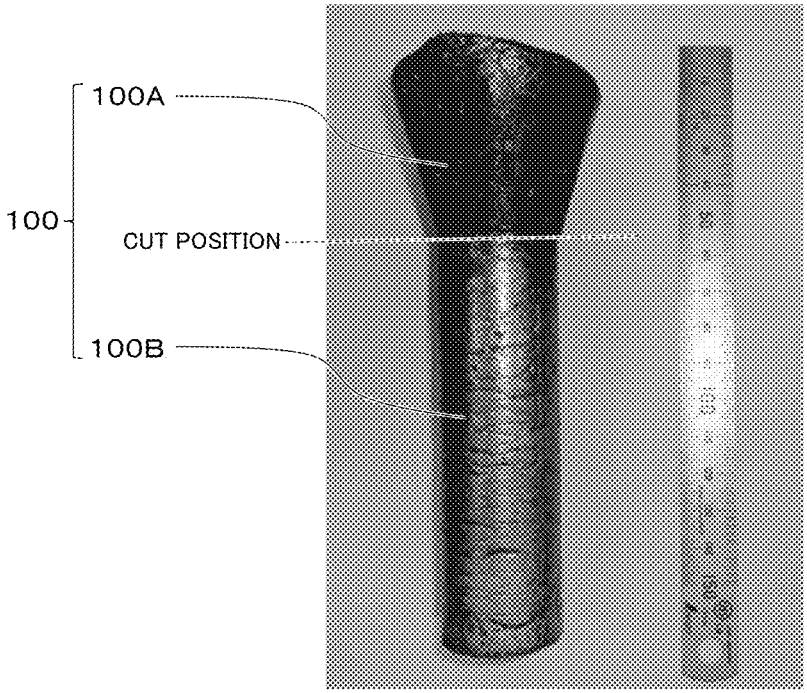
FIG. 1 is a photograph of a sample of Alloy No. 12 according to Example 1 of the present invention.

According to a first embodiment of the present invention, a titanium alloy includes aluminum (Al) at a ratio of 28.0 at % (atomic percent) or more and 38.0 at % or less, iron (Fe) which is a n-stabilizing element at a ratio of 2.0 at % or more and 6.0 at % or less, and titanium (Ti) and inevitable impurities as the balance. When this composition is convened in terms of wt %, Al is 17.8 wt % or more and 25.6 wt % or less and Fe is 2.6 wt % or more and 8.3 wt % or less.

(Example of Method of Manufacturing Material for Timepiece Exterior Part)

First, raw materials of aluminum, iron, and titanium are melted in a melting furnace, and the melt is placed in a mold and solidified to obtain a titanium alloy (alloy forming step).

Next, the titanium alloy is placed in a heating furnace and heated at a temperature of 1200° C. or higher and 1300° C. or lower. Then, the material is taken out from the furnace and perform hot forging at room temperature in the atmosphere (hot forging step). As a method of forging, for example, it is possible to use upsetting (a method of compressing the material in a longitudinal direction) or stretching (a method of stretching the material in a direction perpendicular to the longitudinal direction of the material). In addition, it is not limited to the forging, other hot working methods such as rolling or extrusion may also be used.

Next, the titanium alloy which was hot forged is placed in a heat treatment furnace and heat treated. In the heat treatment, after heating at a temperature of 1200° C. or higher and 1300° C. or lower, the titanium alloy is taken out from the furnace and cooled (heat treatment step). It is necessary that a cooling rate is high, and the cooling rate equal to or higher than that of air cooling is desirable.

(Configuration of Material for Timepiece Exterior Part)

The material for a timepiece exterior part, obtained by the above manufacturing method is made of titanium alloy according to the present embodiment, and a microstructure thereof is homogenized. In addition, since the material itself is hard, a surface treatment is not necessary, and mirror polishing can be performed, the material has features of less unevenness in color tone and luminous intensity, and hard to be scratched.

Second Embodiment

According to a second embodiment of the present invention, a titanium alloy includes aluminum (Al) at a ratio of 28.0 at % or more and 38.0 at % or less, manganese (Mn) which is a β-stabilizing element at a ratio of 4.0 at % or more and 8.0 at % or less, and titanium (Ti) and inevitable impurities as the balance. When this composition is converted in terms of wt % Al is 17.7 wt % or more and 25.5 wt % or less and Mn is 5.2 wt % or more and 10.9 wt % or less.

The titanium alloy according to the present embodiment has the same configuration as the configuration of the titanium alloy according to the first embodiment, except that the titanium alloy according to the present embodiment includes Mn instead of Fe, as a β-stabilizing element. The titanium alloy according to the present embodiment exhibits an effect equivalent to the titanium alloy according to the first embodiment. Accordingly, also for the titanium alloy according to the present embodiment, the method of manufacturing a material for a timepiece exterior part described as the first embodiment can be applied and the material for a timepiece exterior part, having the same configuration as the first embodiment can be obtained.

Third Embodiment

A titanium alloy according to a third embodiment of the present invention includes aluminum (Al) and iron (Fe) respectively at the same ratios as those of the titanium alloy of the first embodiment, and further includes silicon (Si) at a ratio of 0.3 at % or more and 1.5 at % or less. In addition, the titanium alloy according to the third embodiment includes titanium (Ti) and inevitable impurities as the balance.

The titanium alloy according to the third embodiment has the same configuration as the configuration of the titanium alloy according to the first embodiment, except for including Si. Even at a slower cooling rate, hardness equivalent to the titanium alloy according to the first embodiment can be obtained.

As described by taking the first embodiment as an example, in the present invention, it is necessary that a heat forged titanium alloy is placed in a heat treatment furnace to perform the heat treatment. In the heat treatment, first, the titanium alloy is heated at a temperature of 1230° C. or higher and 1330° C. or lower, and then, is taken out from the furnace to be cooled.

At this time, it is necessary that a cooling rate is high, and the cooling rate equal to or higher than that of air cooling is desirable. Examples of the treatment in which the cooling rate is equal to or higher than that of the air cooling include air cooling, oil cooling, water cooling, and the like, in the order of increasing cooling rate, and the hardness of the obtained titanium alloy is also improved in this order.

Accordingly, when considering only the improvement of the hardness, water cooling is most desirable. However, on the other hand, in a case where a size of a material is large, thermal stress generated during cooling increases. Accordingly, in a case where cooling at an extremely high speed, such as water cooling or oil cooling was performed, in a material having a size larger than a certain size, there is a possibility that the material will crack. An object of the titanium alloy according to the third embodiment is to avoid this possibility. The titanium alloy according to the third embodiment exhibits an effect that hardness necessary for the cooling rate that approximates to that of air cooling and slower than those of oil cooling and water cooling, in addition to the same effect as that of the first embodiment. The titanium alloy of the third embodiment can also be obtained by oil cooling and water cooling. In this case, the titanium alloy of the third embodiment becomes harder than the titanium alloy of the first embodiment or the second embodiment.

EXAMPLES

Hereinafter, the effect of the present invention will be made clearer based on Examples. The present invention is not limited to the following Examples, but can be performed with appropriate modifications within the scope not changing the gist thereof.

Ingots of various compositions were prepared by melting and casting method, and implementation of order transformation from a β phase to a B2 phase, which is the object of the present invention was performed by a heat treatment test of small pieces. In addition, a Vickers hardness test was performed on a polished surface of a cross section of the heat treated test piece to determine the Vickers hardness, and the presence or absence of occurrence of cracking from an indentation end was investigated. From the test, hardness at room temperature and a degree of brittleness which are objects of the present invention were evaluated. Next, a hot forging test at 1250° C. was performed to investigate the presence or absence of cracking of the material after forging. From the test, hot forgeability which is another object of the present invention was evaluated. Hereinafter, a specific description will be provided using the drawings.

Example 1

Sponge Ti. Al pellet, and particulate Fe (additive element) were stored in an yttria crucible as a raw material to be melted. The raw material to be melted was prepared to include Al at a ratio of 30.0 at %, Fe at a ratio of 2.0 at %, and Ti as a main remainder, and the total amount thereof was approximately 500 g.

Next, an inside of a chamber of a high-frequency melting furnace equipped with the crucible was evacuated, and then an argon gas was introduced therein. In this state, melting was performed. After all the raw materials were melted, the melted raw material was kept for approximately 3 minutes while applying high frequency output in that state, and then casting was performed. For the casting, an iron mold having a casting part with a diameter of 30 mm and a length of 100 mm was used. In addition, an alumina funnel was placed at an open end of the casting part, and a part of the inside of the funnel was filled with molten metal. The molten metal in the funnel was made to function as a feeding head in order to reduce casting defects of the ingot in the mold.

An appearance photograph of an ingot 100 obtained is shown in FIG. 1. The ingot 100 includes a conical portion 100A and a rod-shaped portion 100B. Since the conical portion 100A was a feeding head portion solidified in the funnel, the conical portion 100A was cut off and the remaining rod-shaped portion 100B (which has a diameter of 30 mm and a length of 90 mm) was used as a sample of a heat treatment test, a Vickers hardness test, and a hot forging test which will be described later.

Comparative Example 11

Sponge Ti, Al pellet, and particulate Fe (additive element) were stored in an yttria crucible as a raw material to be melted. The raw material to be melted was prepared to include Al at a ratio of 28.0 at %, Fe at a ratio of 1.0 at %, and Ti as a main remainder, and the total amount thereof was approximately 500 g.

Next, the prepared raw material to be melted was melted and cast in the same procedure as in Example 1 to obtain a rod-shaped ingot to be a sample of the heat treatment test, the Vickers hardness test, and the hot forging test.

[Heat Treatment Test]

From each of the sample of Example 1 and the sample of Comparative Example 11, a small piece of a portion of 10 mm×10 mm×10 mm including a cut surface with the feeding head portion was cut out, and the heat treatment test was performed on each small piece. Specifically, the heat treatment of keeping at 1250° C. for 2 hours was performed on each small piece, followed by water cooling. The center of the small piece was cut and embedded in a resin and then polished to obtain a test piece for structure observation and hardness measurement.

Figure 2A:
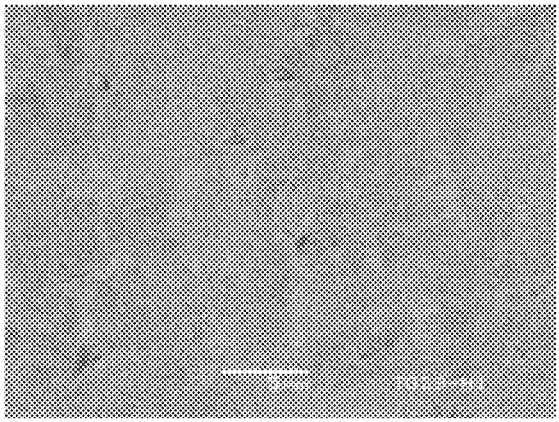
FIG. 2A is a microstructure of a cross section of the sample of Alloy No. 12 according to Example 1 of the present invention, after a heat treatment.
Figure 2B:
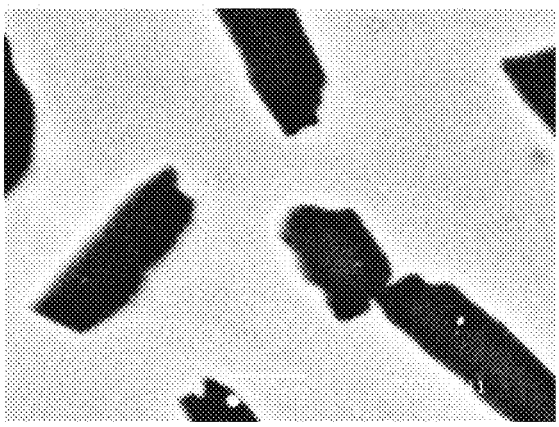
FIG. 2B is a microstructure of a cross section of a sample of Alloy No. 11 according to Comparative Example 11 of the present invention, after the heat treatment.

Backscattered electron images at the center of the cut surface of the small piece after the heat treatment test, which are obtained using a scanning electron microscope are shown FIGS. 2A and 2B. FIG. 2A corresponds to Example 1, and FIG. 2B corresponds to Comparative Example 11.

[Vickers Hardness Test]

The Vickers hardness test was performed on the sample of Example 1 and the sample of Comparative Example 11, using the same test piece as above. A diamond indenter was pressed against the polished surface with a load of 20 kgf and the length of a diagonal line of a recessed portion was measured to be determine a Vickers hardness.

In the sample of Example 1, Vickers hardness was HV 653. From the result, it can be seen that the sample of Example 1 has sufficient hardness as an exterior part of a timepiece or the like. On the other hand, in the sample of Comparative Example 11, Vickers hardness was HV 566. From the result, it can be seen that the sample of Comparative Example 11 is much harder than the Ti alloy of the related art, but it was short of HV 600 which is a criterion of hardness of extent that a surface treatment is not necessary.

Figure 3A:
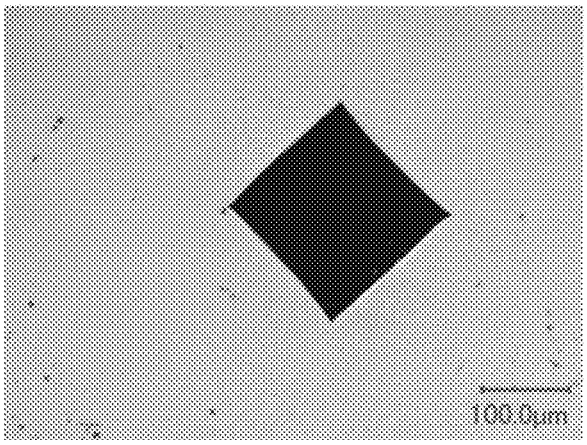
FIG. 3A is a photograph showing a state of circumference of an indentation after a Vickers hardness test of the sample of Alloy No. 12 according to Example 1 of the present invention, after the heat treatment.
Figure 3B:
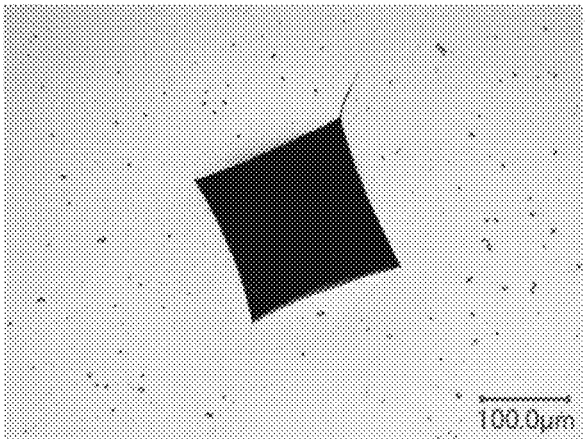
FIG. 3B is a photograph showing a state of circumference of an indentation after the Vickers hardness test of the sample of Alloy No. 11 according to Comparative Example 11 of the present invention, after the heat treatment.

Photographs of recessed portion by the Vickers hardness test, which are obtained by an optical microscopy, in the sample of Example 1 and the sample of Comparative Example 11 are shown in FIGS. 3A and 3B. FIG. 3A corresponds to Example 1, and FIG. 3B corresponds to Comparative Example 11. From the fact that a crack (cracking) due to the Vickers hardness test did not occur in a surface of the sample of Example 1, it can be seen that the sample of Example 1 has a certain degree of toughness. On the other hand, from the fact that a crack due to the Vickers hardness test has occurred at an end (indentation end) of the recess, in the surface of the sample of Comparative Example 11, it can be seen that the sample of Comparative Example 11 does not have the necessary toughness.

[Hot Forging Test]

The hot forging test was performed on the sample of Example 1 and the sample of Comparative Example 11 (which have a diameter of 30 mm and a length of 90 mm). Specifically, first, each sample was placed in the heating furnace, kept at 1250° C. for approximately 30 minutes, and then taken out from the heating furnace. Next, each sample taken out was hydraulically pressed at 300 tons, and upsetting forging was performed at once, until the length thereof becomes 20 mm.

Figure 4A:
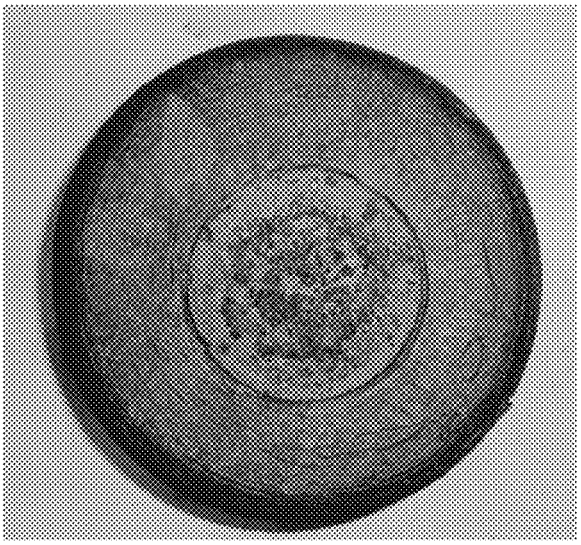
FIG. 4A is a photograph of an exterior of the sample of Alloy No. 12 according to Example 1 of the present invention, after a forging test.
Figure 4B:
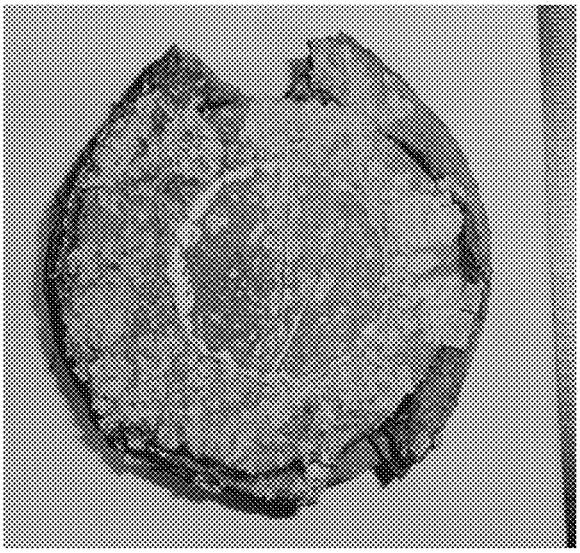
FIG. 4B is a photograph of an exterior of the sample of Alloy No. 11 according to Comparative Example 11 of the present invention, after the forging test.

Photographs of the sample of Example 1 and the sample of Comparative Example 11, after hot forging test, are respectively shown in FIGS. 4A and 4B. From FIG. 4A, it can be seen that cracking due to the hot forging did not occur in the sample of Example 1 and the sample of Example 1 is excellent in hot forgeability. Therefore, in the sample of Example 1, it is possible to obtain a titanium alloy as a timepiece exterior part, in which hot forging can be performed without problems and the microstructure has been homogenized. On the other hand, from FIG. 4B, it can be seen that cracking due to the hot forging has occurred in the sample of Comparative Example 11 and the sample of Comparative Example 11 is not excellent in hot forgeability. Therefore, in the sample of Comparative Example 11, there is a problem with performing the hot forging, and it is difficult to obtain a titanium alloy as a timepiece exterior part, in which the microstructure has been homogenized.

Titanium alloys (ingots) each having a composition different from those of the titanium alloys of Example 1 and Comparative Example 11 were prepared as samples of Comparative Examples 1 to 10 and 12 to 24 and Examples 2 to 13, in the same procedure as in Example 1 and Comparative Example 11. A Vickers hardness test under the same conditions as above and a hot forging test under the same conditions as above were performed on the samples.

Compositions and test results of the samples of Comparative Examples 1 to 9 including any of Cu, V, Nb, Mo, and W as a β-stabilizing element are shown in Table 1. In addition, compositions and test results of the samples of Comparative Examples 10 to 16 and Examples 1 to 7 including Fe as a β-stabilizing element are shown in Table 2. In addition, compositions and test results of the samples of Comparative Examples 17 to 24 and Examples 8 to 13 including Mn as a β-stabilizing element are shown in Table 3.

TABLE 1

| Alloy | | Mixed Components (at %) | | | | | | | | | Evaluation results of material which was heat treated at 1250° C. for 2 hours and water cooled Vickers hardness test with 20 kgf | | |
|---|---|---|---|---|---|---|---|---|---|---|---|---|---|
| No. | Classification | Al | Fe | Mn | Cu | V | Nb | Mo | W | Ti | Hardness (HV) | Presence or absence of cracking | Presence or absence of cracking in forging test at 1250° C. |
| 1 | Comparative Example 1 | 32.0 | | | 3.0 | | | | | Balance | 612 | Occurred | None |
| 2 | Comparative Example 2 | 38.0 | | | 8.0 | | | | | Balance | | | Occurred |
| 3 | Comparative Example 3 | 35.0 | | | | 12.5 | | | | Balance | 439 | None | Occurred |
| 4 | Comparative Example 4 | 32.5 | | | | | 9.0 | | | Balance | 575 | None | Occurred |
| 5 | Comparative Example 5 | 39.5 | | | | | 17.5 | | | Balance | 603 | Occurred | Occurred |
| 6 | Comparative Example 6 | 35.0 | | | | | | 3.0 | | Balance | 600 | Occurred | Occurred |
| 7 | Comparative Example 7 | 37.0 | | | | | | 6.0 | | Balance | 557 | Occurred | Occurred |
| 8 | Comparative Example 8 | 35.0 | | | | | | | 5.0 | Balance | | | Occurred |
| 9 | Comparative Example 9 | 39.5 | | | | | | | 10.0 | Balance | | | Occurred |

TABLE 2

| Alloy | | Mixed Components (at %) | | | | | | | | | Evaluation results of material which was heat treated at 1250° C. for 2 hours and water cooled Vickers hardness test with 20 kgf | | |
|---|---|---|---|---|---|---|---|---|---|---|---|---|---|
| No. | Classification | Al | Fe | Mn | Cu | V | Nb | Mo | W | Ti | Hardness (HV) | Presence or absence of cracking | Presence or absence of cracking in forging test at 1250° C. |
| 10 | Comparative Example 10 | 27.0 | 6.0 | | | | | | | Balance | 720 | None | Occurred |
| 11 | Comparative Example 11 | 28.0 | 1.0 | | | | | | | Balance | 566 | Occurred | Occurred |
| 12 | Example 1 | 30.0 | 2.0 | | | | | | | Balance | 653 | None | None |
| 13 | Example 2 | 30.0 | 6.0 | | | | | | | Balance | 618 | None | None |
| 14 | Example 3 | 31.0 | 3.0 | | | | | | | Balance | 746 | None | None |
| 15 | Example 4 | 31.0 | 5.0 | | | | | | | Balance | 715 | None | None |
| 16 | Example 5 | 32.0 | 6.0 | | | | | | | Balance | 672 | None | None |
| 17 | Comparative Example 12 | 32.0 | 8.0 | | | | | | | Balance | 713 | None | Occurred |
| 18 | Example 6 | 35.0 | 4.0 | | | | | | | Balance | 672 | None | None |
| 19 | Comparative Example 13 | 35.0 | 7.0 | | | | | | | Balance | 655 | None | Occurred |
| 20 | Comparative Example 14 | 35.0 | 10.0 | | | | | | | Balance | 680 | None | Occurred |

TABLE 2-continued

| Alloy | | Mixed Components (at %) | | | | | | | | | Evaluation results of material which was heat treated at 1250° C. for 2 hours and water cooled Vickers hardness test with 20 kgf | | Presence or absence of cracking in forging test at 1250° C. |
|---|---|---|---|---|---|---|---|---|---|---|---|---|---|
| No. | Classification | Al | Fe | Mn | Cu | V | Nb | Mo | W | Ti | Hardness (HV) | Presence or absence of cracking | |
| 21 | Example 7 | 38.0 | 4.0 | | | | | | | Balance | 639 | None | None |
| 22 | Comparative Example 15 | 38.0 | 8.0 | | | | | | | Balance | 678 | None | Occurred |
| 23 | Comparative Example 16 | 39.0 | 4.0 | | | | | | | Balance | 640 | None | Occurred |

TABLE 3

| Alloy | | Mixed Components (at %) | | | | | | | | | Evaluation results of material which was heat treated at 1250° C. for 2 hours and water cooled Vickers hardness test with 20 kgf | | Presence or absence of cracking in forging test at 1250° C. |
|---|---|---|---|---|---|---|---|---|---|---|---|---|---|
| No. | Classification | Al | Fe | Mn | Cu | V | Nb | Mo | W | Ti | Hardness (HV) | Presence or absence of cracking | |
| 24 | Comparative Example 17 | 27.0 | | 5.0 | | | | | | Balance | 632 | Occurred | None |
| 25 | Comparative Example 18 | 28.0 | | 3.0 | | | | | | Balance | 628 | None | Occurred |
| 26 | Example 8 | 30.0 | | 8.0 | | | | | | Balance | 757 | None | None |
| 27 | Example 9 | 32.0 | | 4.0 | | | | | | Balance | 635 | None | None |
| 28 | Example 10 | 32.0 | | 6.0 | | | | | | Balance | 675 | None | None |
| 29 | Comparative Example 19 | 34.0 | | 3.0 | | | | | | Balance | 641 | Occurred | Occurred |
| 30 | Example 11 | 34.0 | | 6.0 | | | | | | Balance | 671 | None | None |
| 31 | Comparative Example 20 | 34.0 | | 9.0 | | | | | | Balance | 710 | Occurred | None |
| 32 | Comparative Example 21 | 35.0 | | 10.0 | | | | | | Balance | 685 | Occurred | Occurred |
| 33 | Example 12 | 37.0 | | 6.0 | | | | | | Balance | 630 | None | None |
| 34 | Example 13 | 38.0 | | 6.0 | | | | | | Balance | 683 | None | None |
| 35 | Comparative Example 22 | 39.0 | | 9.0 | | | | | | Balance | 689 | Occurred | None |
| 36 | Comparative Example 23 | 39.5 | | 12.0 | | | | | | Balance | 689 | Occurred | Occurred |
| 37 | Comparative Example 24 | 42.0 | | 6.0 | | | | | | Balance | 535 | Occurred | None |

The samples of Examples 3, 6, and 14 to 21 with different compositions and the samples of Comparative Examples 25 and 26 to be compared thereto were prepared as a titanium alloy according to the third embodiment. An evaluation test was performed on the samples under the same conditions as above except for both cases where a cooling method after the heat treatment was air cooled and water cooled. Compositions and test results of respective samples are shown in Table 4.

TABLE 4

| Alloy | | Mixed Components (at %) | | | | Evaluation results of material which was heat treated at 1250° C. for 2 hours and air cooled Vickers hardness test with 20 kgf | | Evaluation results of material which was heat treated at 1250° C. for 2 hours and water cooled Vickers hardness test with 20 kgf | | Presence or absence of cracking in forging |
|---|---|---|---|---|---|---|---|---|---|---|
| No. | Classification | Al | Fe | Si | Ti | Hardness (HV) | Presence or absence of cracking | Hardness (HV) | Presence or absence of cracking | test at 1250° C. |
| 14 | Example 3 | 31.0 | 3.0 | | Balance | 530 | None | 746 | None | None |
| 38 | Example 14 | 31.0 | 3.0 | 0.2 | Balance | 576 | None | 762 | None | None |
| 39 | Example 15 | 31.0 | 3.0 | 0.3 | Balance | 614 | None | 776 | None | None |
| 40 | Example 16 | 31.0 | 3.0 | 0.9 | Balance | 668 | None | 793 | None | None |
| 41 | Example 17 | 31.0 | 3.0 | 1.5 | Balance | 723 | None | 801 | None | None |
| 42 | Comparative Example 25 | 31.0 | 3.0 | 1.7 | Balance | 754 | Occurred | 817 | Occurred | Occurred |
| 18 | Example 6 | 35.0 | 4.0 | | Balance | 561 | None | 672 | None | None |
| 43 | Example 18 | 35.0 | 4.0 | 0.2 | Balance | 589 | None | 683 | None | None |
| 44 | Example 19 | 35.0 | 4.0 | 0.3 | Balance | 634 | None | 707 | None | None |
| 45 | Example 20 | 35.0 | 4.0 | 0.9 | Balance | 689 | None | 722 | None | None |
| 46 | Example 21 | 35.0 | 4.0 | 1.5 | Balance | 735 | None | 787 | None | None |
| 47 | Comparative Example 26 | 35.0 | 4.0 | 1.7 | Balance | 769 | Occurred | 804 | Occurred | Occurred |

For the samples of Examples and Comparative Examples shown in Tables 1 to 4, the same tests as those shown above were performed, and evaluated based on the following evaluation criteria (a) to (f).

[Evaluation Criteria]

Regarding Tables 1 to 3:

(a) After the heat treatment at 1250° C. for 2 hours, the Vickers hardness of a polished surface of a cross section of a test piece of a water-cooled small piece was tested under a load of 20 kgf. A test piece with HV 600 or more was regarded as an appropriate sample and a test piece with HV less than 600 was regarded as an inappropriate sample.

(b) Regarding cracking from the indentation end in the Vickers hardness test, a test piece in which the cracking did not occur is regarded as an appropriate sample, and a test piece in which the cracking has occurred is regarded as an inappropriate sample.

(c) As a result of the forging test at 1250° C. performed using an ingot having a diameter of 30 mm and a length of 90 mm, a material in which cracking did not occur after the forging is regarded as an appropriate sample, and a material in which the cracking has occurred is regarded as an inappropriate sample.

Regarding Table 4:

(d) After the heat treatment at 1250° C. for 2 hours, the Vickers hardness of a polished surface of a cross section of a test piece of an air-cooled or water-cooled small piece was tested under a load of 20 kgf. A test piece with HV 600 or more was regarded as an appropriate sample and a test piece with HV less than 600 was regarded as an inappropriate sample.

(e) Same as above (b).

(f) Same as above (c).

The sample (Alloy No. 1) of Comparative Example 1 was obtained by adding 3 at % of Cu and has good hardness and forgeability. However, since the cracking has occurred from a Vickers indentation end, there is a problem with toughness. Therefore, the sample of Comparative Example 1 is an inappropriate sample.

The sample (Alloy No. 2) of Comparative Example 2 was obtained by adding 8 at % of Cu. Since the cracking has occurred due to the forging test, there is a problem with forgeability. Therefore, the sample of Comparative Example 2 is an inappropriate sample.

The sample (Alloy No. 3) of Comparative Example 3 was obtained by adding 12.5 at % of V. Since the Vickers hardness is less than 600, there is a problem with hardness. Further, since the cracking has occurred due to the forging test, there is a problem with forgeability. Therefore, the sample of Comparative Example 3 is an inappropriate sample.

The sample (Alloy No. 4) of Comparative Example 4 was obtained by adding 9 at % of Nb. Since the Vickers hardness is less than 600 there is a problem with hardness. Further, since the cracking has occurred due to the forging test, there is a problem with forgeability. Therefore, the sample of Comparative Example 4 is an inappropriate sample.

The sample (Alloy No. 5) of Comparative Example 5 was obtained by adding 17.5 at % of Nb. Since the cracking has occurred from the Vickers indentation end, there is a problem with toughness. Further, since the cracking has occurred due to the forging test, there is a problem also in forgeability. Therefore, the sample of Comparative Example 5 is an inappropriate sample.

The sample (Alloy No. 6) of Comparative Example 6 was obtained by adding 3.0 at % of Mo. Since the cracking has occurred from the Vickers indentation end, there is a problem with toughness. In addition, since the cracking has occurred due to the forging test, there is a problem also in forgeability. Therefore, the sample of Comparative Example 6 is an inappropriate sample.

The sample (Alloy No. 7) of Comparative Example 7 was obtained by adding 6.0 at % of Mo. Since the Vickers hardness is less than 600, there is a problem with hardness. Since the cracking has occurred from the Vickers indentation end, there is a problem with toughness. Since the cracking has occurred due to the forging test, there is a problem also in forgeability. Therefore, the sample of Comparative Example 7 is an inappropriate sample.

The sample (Alloy No. 8) of Comparative Example 8 was obtained by adding 5.0 at % of W. Since the cracking has occurred due to the forging test, there is a problem with forgeability. Therefore, the sample of Comparative Example 8 is an inappropriate sample.

The sample (Alloy No. 9) of Comparative Example 9 was obtained by adding 10.0 at % of W. Since the cracking has occurred due to the forging test, there is a problem with forgeability. Therefore, the sample of Comparative Example 9 is an inappropriate sample.

The sample (Alloy No. 10) of Comparative Example 10 was obtained by adding 27.0 at % of Al and 6.0 at % of Fe. Since an Al content is less than a range defined in the present invention and the cracking has occurred due to the forging test, there is a problem with forgeability. Therefore, the sample of Comparative Example 10 is an inappropriate sample.

The sample (Alloy No. 11) of Comparative Example 11 is as described above. Since the Vickers hardness is less than 600, there is a problem with hardness. Since the cracking has occurred from the Vickers indentation end, there is a problem with toughness. Since the cracking has occurred due to the forging test, there is also a problem in forgeability. Therefore, the sample of Comparative Example 11 is an inappropriate sample.

The sample (Alloy No. 12) of Example 1 is as described above, and was obtained by adding 30.0 at % of Al and 2.0 at % of Fe.

The sample (Alloy No. 13) of Example 2 was obtained by adding 30.0 at % of Al and 6.0 at % of Fe.

The sample (Alloy No. 14) of Example 3 was obtained by adding 31.0 at % of Al and 3.0 at % of Fe.

The sample (Alloy No. 15) of Example 4 is, and was obtained by adding 31.0 at % of Al and 5.0 at % of Fe.

The sample (Alloy No. 16) of Example 5 was obtained by adding 32.0 at % of Al and 6.0 at % of Fe.

In all the samples of Examples 1 to 5, since the Vickers hardness exceeds 600, hardness is sufficient. Since the cracking did not occur from the Vickers indentation end, toughness is sufficient. In addition, since the cracking due to the forging test did not occur, forgeability is sufficient. Therefore, the samples of Examples 1 to 5 are appropriate samples.

The sample (Alloy No. 17) of Comparative Example 12 was obtained by adding 32.0 at % of Al and 8.0 at % of Fe, and a Fe content is more than a range defined in the present invention. In the sample of Comparative Example 12, since the cracking has occurred due to the forging test, there is a problem with forgeability. Therefore, the sample of Comparative Example 12 is an inappropriate sample.

The sample (Alloy No. 18) of Example 6 was obtained by adding 35.0 at % of Al and 4.0 at % of Fe. In the sample of Example 6, since the Vickers hardness exceeds 600, hardness is sufficient. Since the cracking did not occur from the Vickers indentation end, toughness is sufficient. In addition, since the cracking due to the forging test did not occur, forgeability is sufficient. Therefore, the sample of Example 6 is an appropriate sample.

The sample (Alloy No. 19) of Comparative Example 13 was obtained by adding 35.0 at % of Al and 7.0 at % of Fe. and a Fe content is more than a range defined in the present invention. In the sample of Comparative Example 13, since the cracking has occurred due to the forging test, there is a problem with forgeability. Therefore, the sample of Comparative Example 13 is an inappropriate sample.

The sample (Alloy No. 20) of Comparative Example 14 was obtained by adding 35.0 at % of Al and 10.0 at % of Fe, and a Fe content is more than a range defined in the present invention. In the sample of Comparative Example 14, since the cracking has occurred from the Vickers indentation end, there is a problem with toughness. In addition, since the cracking has occurred due to the forging test, there is a problem also in forgeability. Therefore, the sample of Comparative Example 14 is an inappropriate sample.

The sample (Alloy No. 21) of Example 7 was obtained by adding 38.0 at % of Al and 4.0 at % of Fe. In the sample of Example 7, since the Vickers hardness exceeds 600, hardness is sufficient. Since the cracking did not occur from the Vickers indentation end, toughness is sufficient. In addition, since the cracking due to the forging test did not occur, forgeability is sufficient. Therefore, the sample of Example 7 is an appropriate sample.

The sample (Alloy No. 22) of Comparative Example 15 was obtained by adding 38.0 at % of Al and 8.0 at % of Fe, and a Fe content is more than a range defined in the present invention. In the sample of Comparative Example 15, since the cracking has occurred due to the forging test, there is a problem with forgeability. Therefore, the sample of Comparative Example 15 is an inappropriate sample.

The sample (Alloy No. 23) of Comparative Example 16 was obtained by adding 39.0 at % of Al and 4.0 at % of Fe. and a Fe content is more than a range defined in the present invention. In the sample of Comparative Example 16, since the cracking has occurred due to the forging test, there is a problem with forgeability. Therefore, the sample of Comparative Example 16 is an inappropriate sample.

The sample (Alloy No. 24) of Comparative Example 17 was obtained by adding 27.0 at % of Al and 5.0 at % of Mn, and an Al content is less than a range defined in the present invention. In the sample of Comparative Example 17, since the cracking has occurred from the Vickers indentation end, there is a problem with toughness. Therefore, the sample of Comparative Example 17 is an inappropriate sample.

The sample (Alloy No. 25) of Comparative Example 18 was obtained by adding 28.0 at % of Al and 3.0 at % of Mn, and a Mn content is less than a range defined in the present invention. In the sample of Comparative Example 18, since the cracking has occurred due to the forging test, there is a problem with forgeability. Therefore, the sample of Comparative Example 18 is an inappropriate sample.

The sample (Alloy No. 26) of Example 8 was obtained by adding 30.0 at % of Al and 8.0 at % of Mn.

The sample (Alloy No. 27) of Example 9 was obtained by adding 32.0 at % of Al and 4.0 at % of Mn.

The sample (Alloy No. 28) of Example 10 was obtained by adding 32.0 at % of Al and 6.0 at % of Mn.

In all the samples of Examples 8 to 10, since the Vickers hardness exceeds 600, hardness is sufficient. Since the cracking did not occur from the Vickers indentation end, toughness is sufficient. In addition, since the cracking due to the forging test did not occur, forgeability is sufficient. Therefore, the samples of Examples 8 to 10 are appropriate samples.

The sample (Alloy No. 29) of Comparative Example 19 was obtained by adding 34.0 at % of Al and 3.0 at % of Mn.

and a Mn content is less than a range defined in the present invention. In the sample of Comparative Example 19, since the cracking has occurred from the Vickers indentation end, there is a problem with toughness. Since the cracking has occurred due to the forging test, there is a problem also in forgeability. Therefore, the sample of Comparative Example 19 is an inappropriate sample.

The sample (Alloy No. 30) of Example 11 was obtained by adding 34.0 at % of Al and 6.0 at % of Mn. In the sample of Example 11, since the Vickers hardness exceeds 600, hardness is sufficient. Since the cracking did not occur from the Vickers indentation end, toughness is sufficient. In addition, since the cracking due to the forging test did not occur, forgeability is sufficient. Therefore, the sample of Example 11 is an appropriate sample.

The sample (Alloy No. 31) of Comparative Example 20 was obtained by adding 34.0 at % of Al and 9.0 at % of Mn, and a Mn content is more than a range defined in the present invention. In the sample of Comparative Example 20, since the cracking has occurred from the Vickers indentation end, there is a problem with toughness. Therefore, the sample of Comparative Example 20 is an inappropriate sample.

The sample (Alloy No. 32) of Comparative Example 21 was obtained by adding 35.0 at % of Al and 10.0 at % of Mn, and a Mn content is more than a range defined in the present invention. In the sample of Comparative Example 21, since the cracking has occurred from the Vickers indentation end, there is a problem with toughness. Since the cracking has occurred due to the forging test, there is a problem also in forgeability. Therefore, the sample of Comparative Example 21 is an inappropriate sample.

The sample (Alloy No. 33) of Example 12 was obtained by adding 37.0 at % of Al and 6.0 at % of Mn. The sample (Alloy No. 34) of Example 13 was obtained by adding 38.0 at % of Al and 6.0 at % Mn. In all the samples of Examples 12 and 13, since the Vickers hardness exceeds 600, hardness is sufficient. Since the cracking did not occur from the Vickers indentation end, toughness is sufficient. In addition, since the cracking due to the forging test did not occur, forgeability is sufficient. Therefore, the samples of Examples 12 and 13 are appropriate samples.

The sample (Alloy No. 35) of Comparative Example 22 was obtained by adding 39.0 at % of Al and 9.0 at % of Mn, and an Al content and a Mn content are more than ranges defined in the present invention. In the sample of Comparative Example 22, since the cracking has occurred from the Vickers indentation end, there is a problem with toughness. Therefore, the sample of Comparative Example 22 is an inappropriate sample.

The sample (Alloy No. 36) of Comparative Example 23 was obtained by adding 39.5 at % of Al and 12.0 at % of Mn, and an Al content and a Mn content are more than ranges defined in the present invention. In the sample of Comparative Example 23, since the cracking has occurred from the Vickers indentation end, there is a problem with toughness. Since the cracking has occurred due to the forging test, there is a problem also in forgeability. Therefore, the sample of Comparative Example 23 is an inappropriate sample.

The sample (Alloy No. 37) of Comparative Example 24 was obtained by adding 42.0 at % of Al and 6.0 at % of Mn. and an Al content is more than a range defined in the present invention. In the sample of Comparative Example 24, since the Vickers hardness is less than 600, there is a problem with hardness. Since the cracking has occurred from the Vickers indentation end, there is a problem with toughness. Since the cracking has occurred due to the forging test, there is a problem also in forgeability. Therefore, the sample of Comparative Example 24 is an inappropriate sample.

The sample (Alloy No. 14) of Example 3 shown in Table 4 was obtained by adding 31.0 at % of Al and 3.0 at % of Fe, and is obtained in both cases where a cooling method after the heat treatment was air cooling and water cooling. In the sample of Example 3, since the Vickers hardness is less than 600 in a case of air cooling but exceeds 600 in a case of water cooling, hardness is sufficient. Since the cracking did not occur from the Vickers indentation end, toughness is sufficient. In addition, since the cracking due to the forging test did not occur, forgeability is sufficient. Therefore, the sample of Example 3 is an appropriate sample.

The sample (Alloy No. 38) of Example 14 was obtained by adding 31.0 at % of Al, 3.0 at % of Fe, and 0.2 at % of Si, and a Si content is less than a range defined in the present invention. In the sample of Example 14, since the Vickers hardness is less than 600 in a case of air cooling but exceeds 600 in a case of water cooling, hardness is sufficient. Since the cracking did not occur from the Vickers indentation end, toughness is sufficient. In addition, since the cracking due to the forging test did not occur, forgeability is sufficient. Therefore, the sample of Example 14 is an appropriate sample.

The sample (Alloy No. 39) of Example 15 was obtained by adding 31.0 at % of Al, 3.0 at % of Fe, and 0.3 at % of Si. The sample (Alloy No. 40) of Example 16 was obtained by adding 31.0 at % of Al, 3.0 at % of Fe, and 0.9 at % of Si. The sample (Alloy No. 41) of Example 17 was obtained by adding 31.0 at % of Al, 3.0 at % of Fe, and 1.5 at % of Si. In all the cases where the cooling method is water cooling and air cooling, since the Vickers hardness exceeds 600, hardness is sufficient. Since the cracking did not occur from the Vickers indentation end, toughness is sufficient. In addition, since the cracking due to the forging test did not occur, forgeability is sufficient. Therefore, the samples are appropriate.

The sample (Alloy No. 42) of Comparative Example 25 was obtained by adding 31.0 at % of Al, 3.0 at % of Fe, and 1.7 at % of Si., and a Si content is more than a range defined in the present invention. In the sample of Comparative Example 25, since the cracking has occurred from the Vickers indentation end, there is a problem with toughness. Since the cracking has occurred due to the forging test, there is a problem also in forgeability. Therefore, the sample of Comparative Example 25 is an inappropriate sample.

The sample (Alloy No. 18) of Example 6 shown in Table 4 was obtained by adding 35.0 at % of Al and 4.0 at % of Fe, and is obtained in both cases where a cooling method after the heat treatment was air cooling and water cooling. In the sample of Example 6, since the Vickers hardness is less than 600 in a case of air cooling but exceeds 600 in a case of water cooling, hardness is sufficient. Since the cracking did not occur from the Vickers indentation end, toughness is sufficient. In addition, since the cracking due to the forging test did not occur, forgeability is sufficient. Therefore, the sample of Example 6 is an appropriate sample.

The sample (Alloy No. 43) of Example 18 was obtained by adding 35.0 at % of Al, 4.0 at % of Fe, and 0.2 at % of Si. and a Si content is less than a range defined in the present invention. In the sample of Example 18, since the Vickers hardness is less than 600 in a case of air cooling but exceeds 600 in a case of water cooling, hardness is sufficient. Since the cracking did not occur from the Vickers indentation end, toughness is sufficient. In addition, since the cracking due to the forging test did not occur, forgeability is sufficient. Therefore, the sample of Example 18 is an appropriate sample.

The sample (Alloy No. 44) of Example 19 was obtained by adding 35.0 at % of Al, 4.0 at % of Fe, and 0.3 at % of Si. The sample (Alloy No. 45) of Example 20 was obtained by adding 35.0 at % of Al., 4.0 at % of Fe, and 0.9 at % of Si. The sample (Alloy No. 46) of Example 21 was obtained by adding 35.0 at % of Al, 4.0 at % of Fe, and 1.5 at % of Si. In all the cases where the cooling method is water cooling and air cooling, since the Vickers hardness exceeds 600, hardness is sufficient. Since the cracking did not occur from the Vickers indentation end, toughness is sufficient. In addition, since the cracking due to the forging test did not occur, forgeability is sufficient. Therefore, the samples are appropriate.

The sample (Alloy No. 47) of Comparative Example 26 was obtained by adding 35.0 at % of Al, 4.0 at % of Fe, and 1.7 at % of Si., and a Si content is more than a range defined in the present invention. In the sample of Comparative Example 26, since the cracking has occurred from the Vickers indentation end, there is a problem with toughness. Since the cracking has occurred due to the forging test, there is a problem also in forgeability. Therefore, the sample of Comparative Example 26 is an inappropriate sample.

INDUSTRIAL APPLICABILITY

The present alloy of the present invention can be widely used as a material forming an exterior part or the like of a timepiece which is required to have hardness and is used in a state of contacting with a human body.

What is claimed is:

1. A method of manufacturing a material for a timepiece exterior part, the method comprising:

a first heat treatment step of heating a casted titanium alloy at a temperature in a range of 1200° C. or higher and 1300° C. or lower in a furnace, the titanium alloy being cooled down at a room temperature thereafter by taking out from the furnace;

a forging step of forging the titanium alloy after the first heat treatment step at a room temperature in an atmosphere, or a hot working step of performing hot working on the titanium alloy after the first heat treatment step at a room temperature in an atmosphere; and a second heat treatment step of heat-treating the titanium alloy at a temperature in a range of 1200° C. or higher and 1300° C. or lower after the forging step or the hot working step, the titanium alloy being cooled down to a room temperature thereafter to form a timepiece exterior part, wherein the titanium alloy consists of:

aluminum at a ratio of 28.0 at % or more and 38.0 at % or less;

iron at a ratio of 2.0 at % or more and 6.0 at % or less; and titanium and inevitable impurities as the balance, wherein after the second heat treatment step, the titanium alloy is cooled at a cooling rate equal to or higher than that of air cooling, the method is free of a surface hardening treatment step, and the timepiece exterior part has a Vickers hardness of HV 600 or more.

2. A method of manufacturing a material for a timepiece exterior part, the method comprising:

a first heat treatment step of heating a casted titanium alloy at a temperature in a range of 1200° C. or higher and 1300° C. or lower in a furnace, the titanium alloy being cooled down at a room temperature thereafter by taking out from the furnace;

a forging step of forging the titanium alloy after the first heat treatment step at a room temperature in an atmosphere, or a hot working step of performing hot working on the titanium alloy after the first heat treatment step at a room temperature in an atmosphere; and a second heat treatment step of heat-treating the titanium alloy at a temperature in a range of 1200° C. or higher and 1300° C. or lower after the forging step or the hot working step, the titanium alloy being cooled down to a room temperature thereafter to form a timepiece exterior part, wherein the titanium alloy consists of:

aluminum at a ratio of 28.0 at % or more and 38.0 at % or less;

iron at a ratio of 2.0 at % or more and 6.0 at % or less;

silicon at a ratio of 0.3 at % or more and 1.5 at % or less and titanium and inevitable impurities as the balance, wherein after the second heat treatment step, the titanium alloy is cooled at a cooling rate equal to or higher than that of air cooling, and the method is free of a surface hardening treatment step, and the timepiece exterior part has a Vickers hardness of HV 600 or more.

3. The method according to claim 1, wherein the titanium alloy consisting the timepiece exterior part is in a B2 phase of an intermetallic compound phase.

4. The method according to claim 2, wherein the titanium alloy consisting the timepiece exterior part is in a B2 phase of an intermetallic compound phase.

* * * * *